US007044446B2

(12) United States Patent
Hempen et al.

(10) Patent No.: US 7,044,446 B2
(45) Date of Patent: May 16, 2006

(54) REMOVABLE CART CORRAL GUARD

(75) Inventors: Rodney L. Hempen, Braselton, GA (US); Timothy A. Otterlee, Marietta, GA (US); Graham C. Lobban, St. Clements (CA)

(73) Assignees: Redico, Inc., Buford, GA (US); RTS Plastics, Ontario (CA)

( * ) Notice: Subject to any disclaimer, the term of this patent is extended or adjusted under 35 U.S.C. 154(b) by 510 days.

(21) Appl. No.: 10/280,910

(22) Filed: Oct. 25, 2002

(65) Prior Publication Data

US 2004/0079934 A1 Apr. 29, 2004

(51) Int. Cl.
*A47F 10/04* (2006.01)

(52) U.S. Cl. ..... 256/1; 211/17; 211/22

(58) Field of Classification Search ..... 256/1, 256/59; 211/17

See application file for complete search history.

(56) References Cited

U.S. PATENT DOCUMENTS 4,609,183 A 9/1986 Ulmer
5,096,753 A 3/1992 McCue et al.
5,149,569 A 9/1992 McCue
D333,873 S 3/1993 McCue
5,201,426 A * 4/1993 Cruwell, Jr. ..... 211/17
5,279,085 A * 1/1994 DiPaolo et al. ..... 52/169.2
D353,466 S 12/1994 McCue et al.
5,551,578 A 9/1996 McCue et al.
D376,854 S 12/1996 DiPaolo et al.
5,891,534 A 4/1999 Sabin et al.
6,260,237 B1 7/2001 McCue et al.
6,298,997 B1 10/2001 Jarrett et al.
6,581,616 B1 * 6/2003 Venegas, Jr. ..... 135/121

* cited by examiner

*Primary Examiner*—John Cottingham
(74) *Attorney, Agent, or Firm*—Womble Carlyle Sandridge & Rice, PLLC

(57) ABSTRACT

The invention recites a cart corral for the storage of shopping carts. The cart corral including a front portion and a rear portion. A bar is coupled to the front and rear portion to at least partially define a side wall, a cart corral interior, and a cart corral exterior. A side panel is detachably mounted to the bar such that the side panel is disposed substantially within the cart corral exterior.

22 Claims, 6 Drawing Sheets

REMOVABLE CART CORRAL GUARD

BACKGROUND OF THE INVENTION

The present invention relates to shopping cart storage systems. More particularly, the present invention relates to removable guards for cart storage systems.

Cart corrals are often used at grocery stores, shopping centers, department stores, home-repair stores and the like, to provide a convenient place to store shopping carts following use. Generally, the cart corrals are positioned in the parking lot. Often the corrals are surrounded by parking spaces or occupy parking spaces themselves. As such, car doors or cars attempting to park may impact the cart corrals resulting in damage to the cars or the cart corral.

Many cart corrals are fabricated from metal pipes or tubes making them difficult to see in adverse conditions (e.g., night, rain, snow, etc.). In addition, metal pipes and tubes can easily scratch or otherwise damage the surface of a car.

SUMMARY OF THE PREFERRED EMBODIMENTS

According to the present invention a cart corral includes a front portion and a rear portion. A bar is coupled to the front and rear portion to at least partially define a side wall, a cart corral interior, and a cart corral exterior. A side panel is detachably mounted to the bar such that the side panel is disposed substantially within the cart corral exterior.

In another embodiment, the invention provides a guard for a cart corral including a frame having an upper bar and a lower bar. The guard includes an outer wall that defines an internal chamber having a gap. An upper boss cooperates with the outer wall to define a first frame channel sized to receive the upper bar. A lower boss is connected to the outer wall and is positioned to allow the outer wall to substantially surround the lower bar such that the outer wall is removably connectable to the frame.

In yet another embodiment, the present invention provides a guard for a cart corral having a bar. The guard includes a first side wall having an outer surface and an inner surface defining a first boss and a second boss. The outer surface includes a projection. The guard also includes a second side wall having an outer surface and an inner surface defining a first boss and a second boss. The outer surface includes a projection. The inner surface of the first side panel is juxtaposed with the inner surface of the second side panel to define a gap therebetween. A lateral wall interconnects the first side panel and the second side panel such that the first bosses cooperate with the first side wall, the second side wall, and the lateral wall to at least partially define a channel that is sized to removably receive the bar. The second bosses contact one another to maintain the gap between the first and second side panels.

Additional features and advantages will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 7 is a bottom view of the guard of FIG. 2;

FIG. 9 is a perspective view of the guard of FIG. 2 attached to the cart corral of FIG. 1;

DETAILED DESCRIPTION OF THE DRAWINGS

Figure 1:
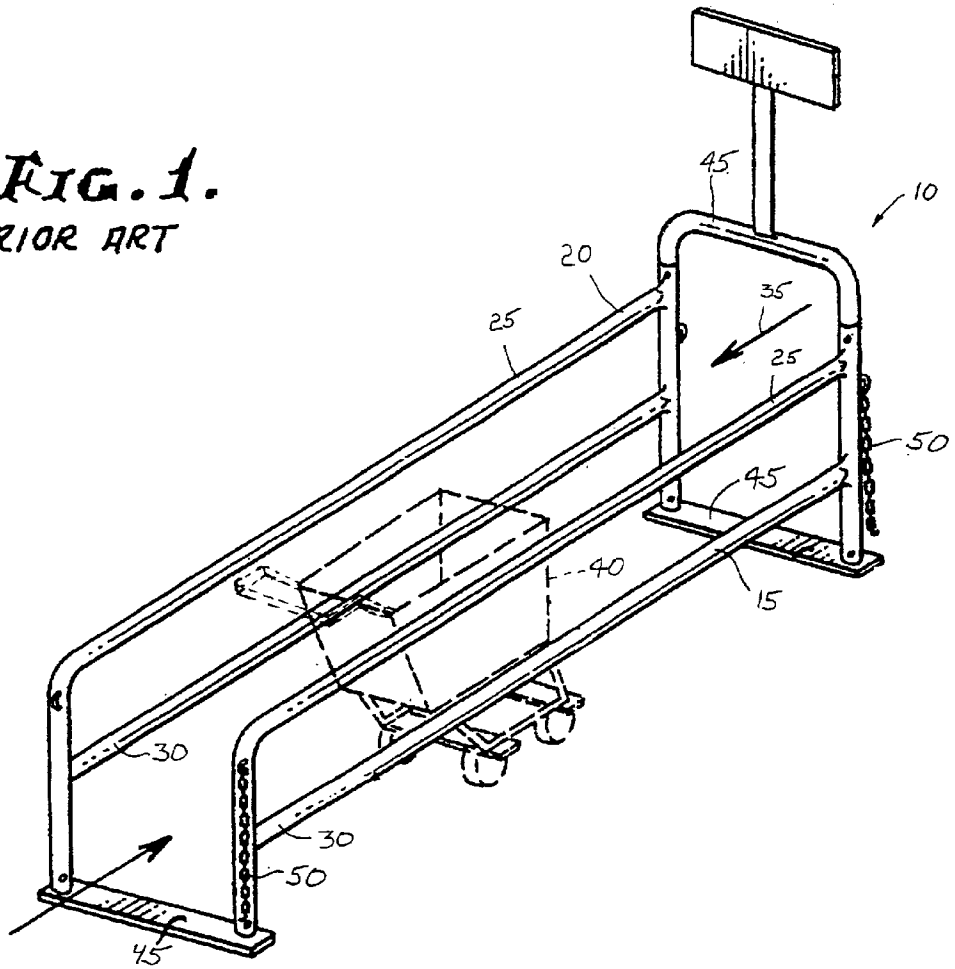
FIG. 1. PRIOR ART
FIG. 1 is a perspective view of a prior art cart corral.

Cart corrals 10 adapted for the storage of shopping carts are known. FIG. 1 illustrates one possible cart corral 10. The cart corral 10 includes a first wall 15 and a second wall 20. Each wall includes an upper bar 25 and a lower bar 30 that extend from one end of the corral 10 to the other. The walls 15, 20 are spaced apart from one another to define a storage area 35 for a shopping cart 40. Transverse members 45 extend between the walls 15, 20 to lock the walls 15, 20 in the desired position relative to one another.

The cart corral 10 of FIG. 1 is configured to allow for the storage of one row of shopping carts 40. Other cart corrals allow for the storage of multiple rows of shopping carts 40. The carts 40 enter from one of the open ends of the corral 10 and nest within each other to allow for efficient storage. One or both ends of the cart corral 10 may include a stop member, such as a chain 50, that prevents the carts 40 from passing out of the corral 10.

Figures 2, 8:
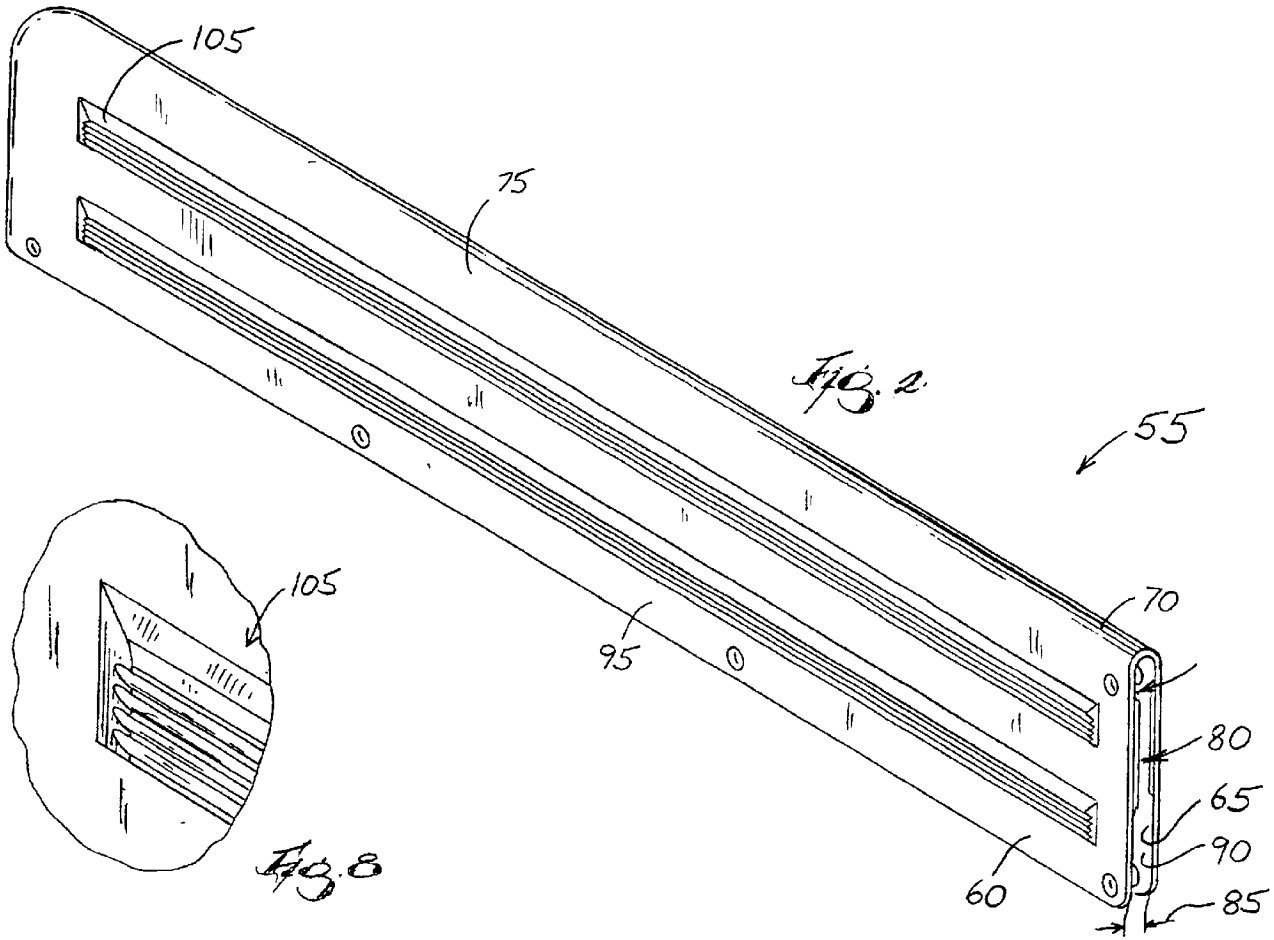
FIG. 2 is a perspective view of a guard embodying the present invention.
FIG. 8 is an enlarged perspective view of the front surface projections of the guard of FIG. 2.

Turning to FIG. 2, a guard 55 adapted to engage a cart corral such as the cart corral 10 of FIG. 1 is illustrated. The guard 55 includes a first side panel 60, a second side panel 65, and a plurality of lateral walls 70 that together define an outer wall 75. Within the outer wall is a chamber 80 that defines a gap 85 between the first side panel 60 and the second side panel 65.

The guard 55 is preferably formed as a single piece in a single molding operation (e.g., rotomolding, injection molding, etc.). However, other constructions employ multi-piece guards with the different pieces attaching to one another using any common attachment mechanism (e.g., bolts, screws, glues, adhesives, welding, soldering, brazing, etc.).

In preferred constructions, the guard 55 is formed from either low or medium density polyethylene with other plastics also being suitable. The use of plastics allows for the molding of the guard 55 in any desired color (e.g., red, orange, blue, violet, or any combination thereof). In some constructions, the guard 55 is molded using a safety color such as fluorescent red, green, or orange to increase the visibility of the guard 55 and the cart corral 10 to which it is attached. In still other constructions, the guard 55 is manufactured from metal or a composite such as fiberglass or rubber coated metal.

The first and second side panels 60, 65 are substantially planar rectangular members having an inner surface 90 and an outer surface 95. The inner surfaces 90 define bosses 100 (discussed below with regard to FIGS. 3–6) that extend out of the plane of the side panels 60, 65.

The outer surfaces define projections 105 (discussed below with regard to FIG. 8) that extend a substantial portion of the length of the side panels 60, 65. The projections 105 extend out of the plane of the panels 60, 65 in the opposite direction as the bosses 100.

The lateral walls 70 extend between the first and second side panels 60, 65 such that the inner surface 90 of the first side panel 60 is juxtaposed with the inner surface 90 of the second side panel 65. The lateral walls 70 define the gap 85 between the first and second side panels 60, 65 and substantially enclose the chamber 80 therewithin. The bottom and one end of the guard 55 remain open to allow for the attachment of the guard 55 to a preexisting cart corral 10 as illustrated in FIG. 9.

Figure 3:
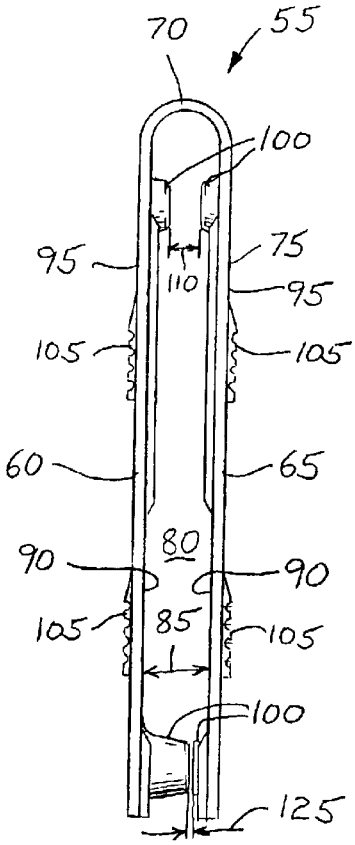
FIG. 3 is an end view of the guard of FIG. 2.
Figure 4:
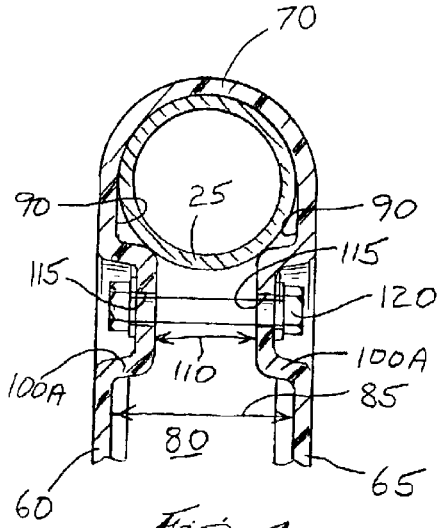
FIG. 4 is an enlarged view of the upper boss of FIG. 3.
Figure 5:
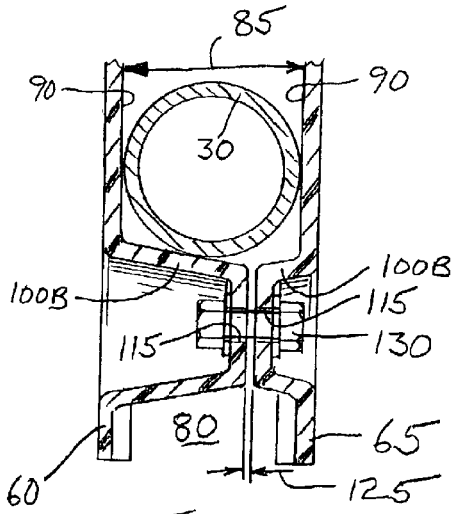
FIG. 5 is an enlarged view of the lower boss of FIG. 3.
Figure 4:
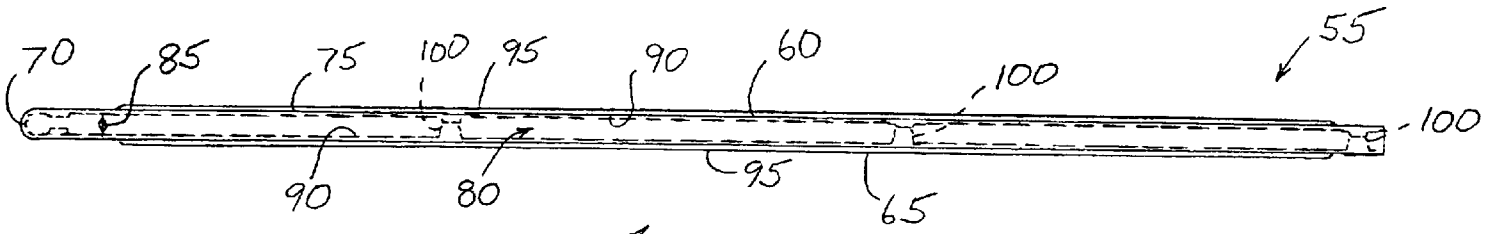

Turning to FIGS. 3–5, an end view of the guard 55 better illustrates the bosses 100. The bosses 100 are arranged in an upper row 100A and a lower row 100B on each of the side panels 60, 65. The upper bosses 100A, illustrated in FIG. 4, are frustoconical projections that protrude from the inner surface 90 of the first and second side panels 60, 65. The individual upper bosses 100A of the first side panel 60 align with the upper bosses 100A of the second side panel 65 to define a narrow gap 110 therebetween. A hole 115 extends through each of the bosses 100A to accommodate a long attachment screw 120.

FIG. 5 better illustrates one of the lower bosses 100B. Like the upper bosses 100A, the lower bosses 100B are frustoconical projections that protrude from the inner surface 90 of the first and second side panels 60, 65. The lower bosses 100B align with one another and define a small gap 125. Alternatively, the lower bosses 100B contact one another. Thus, the lower bosses 100B act as spacers to maintain a minimum desired gap 85 between the first and second side panels 60, 65. Holes 115 extend through the bosses 100B to facilitate short attachment screws 130. In other constructions, the lower bosses 100B are identical to the upper bosses 100A and a separate spacer piece is employed to maintain the minimum gap 85 between the side panels 60, 65.

As best illustrated in FIG. 7, four sets of bosses 100 are used in the illustrated guard 55 with more or less bosses 100 being possible. In other constructions, the bosses 100 are not frustoconical. Instead, the bosses are rectangular or oval projections that extend along a greater length of the guard 55. In still other constructions, a single upper boss and a single lower boss extend a majority of the length of the guard 55.

Figure 6:
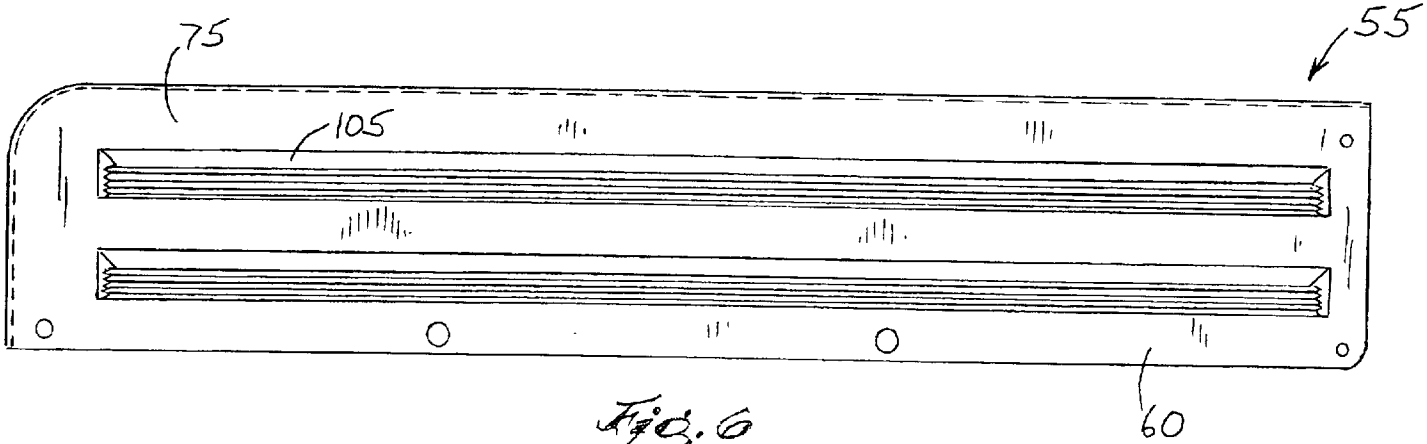
FIG. 6 is front view of the guard of FIG. 2.
Figure 2:
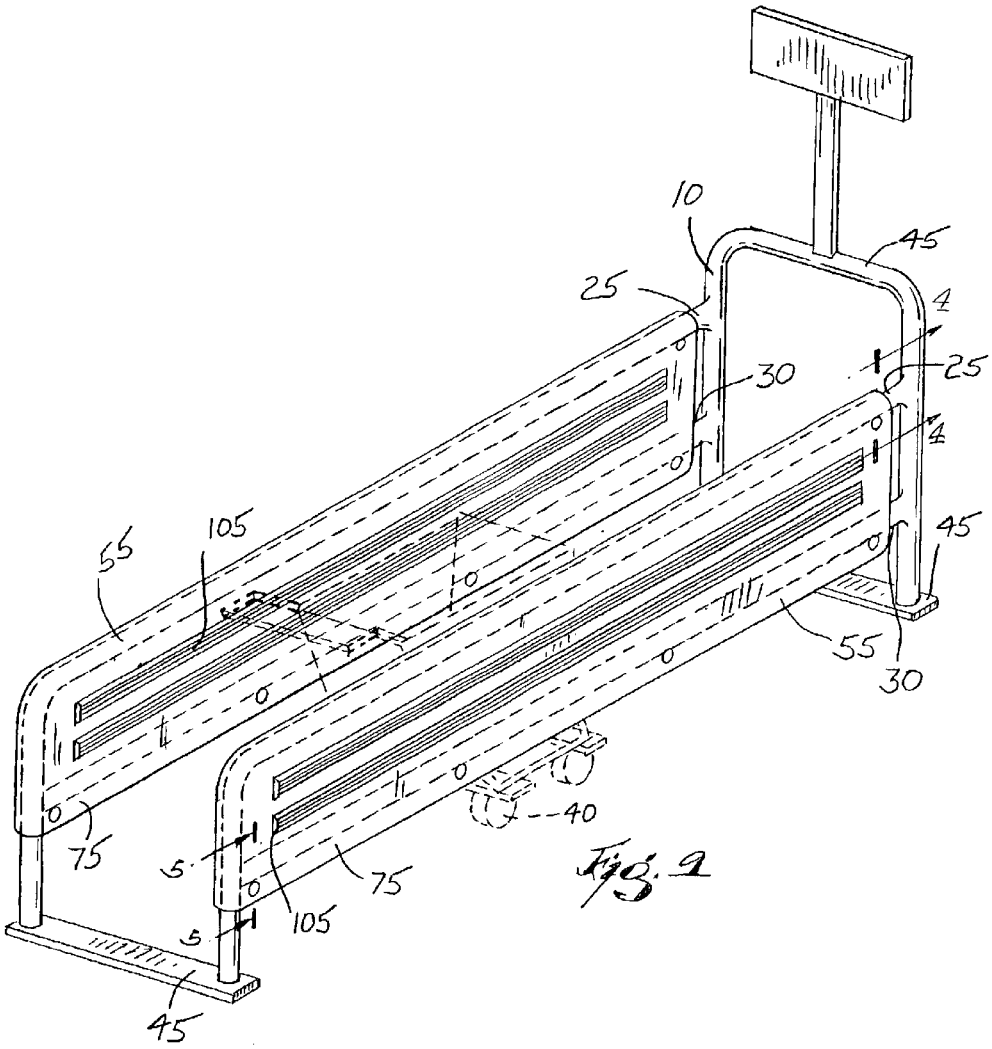

FIGS. 6 and 8 illustrate the projections 105 on the outer surfaces 95 of the first and second panels 60, 65. The projections 105 are essentially a plurality of louvers (best illustrated in FIG. 8) that extend almost the full length of the guard 55. In some constructions, the projections 105 define openings between the outer surface 95 and the inner surface 90 of the panels 60, 65. The projections 105, and openings if employed, improve the quality of the molded guard 55 by reducing the likelihood of distortion. In addition, the projections 105 provide a surface that deflects when impacted by an object. For example, a car door that is opened into the projections 105 will deflect the projections 105 rather than dent the door. In addition, the projections 105 will typically return to their original position following an impact. Thus, the projections 105 act to enhance the guard's ability to prevent damage to external objects.

Figure 10:
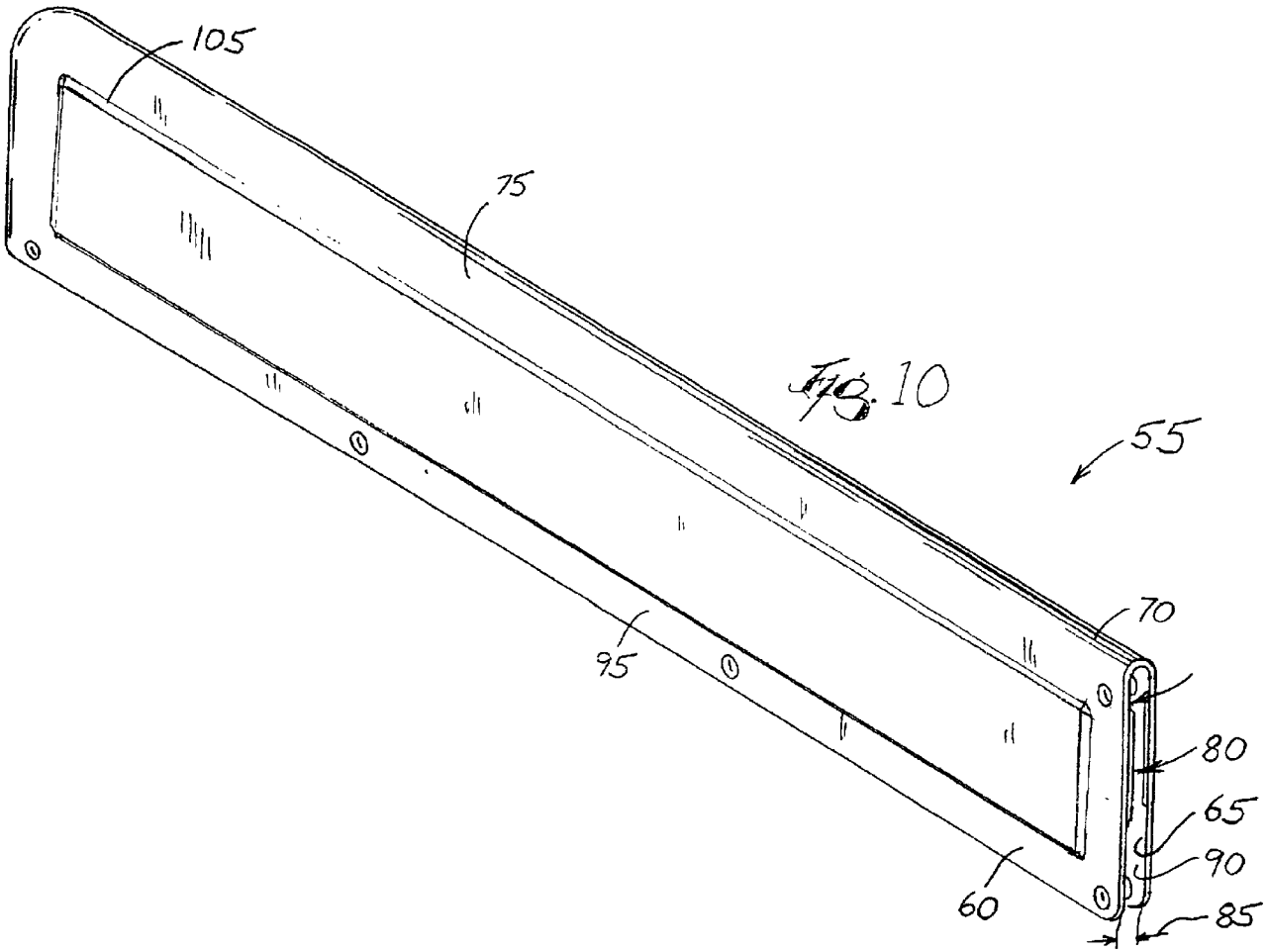
FIG. 10 is a perspective view of another guard embodying the present invention.

Other constructions employ other shaped projections 105 such as frustoconical or spherical. In addition, a plurality of holes may be used to improve the formability of the guard 55. In the construction illustrated in FIG. 10, a large flat projection 135 enhances the guard's ability to absorb impacts and provides a large surface suitable for the application of stickers or decals. Thus, advertisements can be placed on the guard 55 or formed directly into the guard 55.

FIG. 9 illustrates the guard 55 attached to a cart corral 10. To install the guard 55, the open bottom of the guard 55 is positioned immediately above the upper bar 25 of the cart corral 10. The first and second side panels 60, 65 are separated from one another to allow the bar 25 to pass through the gap 125 between the lower bosses 100B and then through the gap 110 between the upper bosses 100A. As the upper bar 25 passes through the gap 110 between the upper bosses 100A, the lower bar 30 passes through the gap 125 between the lower bosses 100B. Once properly positioned, the long and short attachment screws 120, 130 are inserted into the holes 115 provided in the bosses 100. The screws 120, 130 are tightened to firmly retain the guard 55 in the desired position.

The above-procedure is reversed to remove the guard 55. Thus, the guards 55 are removably attached to the cart corral 10 without any disassembly of the preexisting cart corral 10. The ease of installation and removal allows for the use of multiple guards 55 that can be interchanged as desired. For example, the cart corral owner may have guards 55 that include seasonal advertisements. The owner can simply change guards 55 as the seasons change to effectively advertise.

Although the invention has been described in detail with reference to certain preferred embodiments, variations and modifications exist within the scope and spirit of the invention as described and defined in the following claims.

What is claimed is:

1. A cart corral for the storage of shopping cans, the cart corral comprising:

a front portion and a rear portion;

a bar coupled to the front and rear portion to at least partially define a side wall, a cart corral interior, and a cart corral exterior;

a side panel detachably mounted to the bar such that the side panel is disposed substantially within the cart corral exterior, the side panel being detachable without decoupling the bar from the front portion or the rear portion the side panel further comprises an outer side panel and an inner side panel, the outer side panel and the inner side panel cooperating to substantially surround the bar.

2. The cart corral of claim 1, wherein the outer and inner side panels are formed as a single piece.

3. The can corral of claim 1, wherein the outer and inner side panels are formed from plastic.

4. The cart corral of claim 3, wherein the plastic is one of low and medium density polyethylene.

5. The cart corral of claim 1, wherein the outer side panel includes an inner surface defining a plurality of bosses and the inner side panel includes an inner surface defining a second plurality of bosses, the inner surface of the inner side panel juxtaposed with the inner surface of the outer side panel to define a gap therebetween, the bosses of the outer side panel cooperating with the bosses of the inner side panel to removably engage the frame.

6. The cart corral of claim 5, wherein the bosses are frustoconical.

7. The cart corral of claim 5, wherein the bosses are arranged in an upper row of bosses and a lower row of bosses.

8. The cart corral of claim 7, wherein the upper row of bosses are positioned to removably engage the bar and wherein the lower row of bosses contact one another to maintain a gap between the outer side panel and the inner side panel.

9. The cart corral of claim 1, wherein the side panel further includes an outer surface defining a plurality of projections.

10. The cart corral of claim 1, wherein the side panel further includes an outer surface and an inner surface and wherein a plurality of apertures extend from the outer surface to the inner surface.

11. A guard for a cart corral including a frame having an upper bar and a lower bar, the frame supporting the cart corral, the guard comprising:

an outer wall defining an internal chamber having a gap;

an upper boss projecting into the internal chamber and cooperating with the outer wall to at least partially define a first frame channel sized to receive the upper bar; and a lower boss projecting into the internal chamber and contacting the outer wall to at least partially define a second frame channel that is sized to receive the lower bar, the outer wall being removable from the frame without disassembly of the frame.

12. The guard of claim 11, wherein the bosses are frustoconical.

13. The guard of claim 11, wherein the guard is formed as a single piece.

14. The guard of claim 11, wherein the guard is formed from plastic.

15. The guard of claim 11, further comprising a plurality of bosses wherein the bosses are arranged in an upper row of bosses and a lower row of bosses.

16. The guard of claim 15, wherein the upper row of bosses are positioned to removably engage the upper bar of the frame and wherein the lower row of bosses contact one another to maintain the gap.

17. The guard of claim 11, wherein the outer wall defines inner and outer surfaces, and wherein the outer surfaces include a plurality of projections.

18. A guard for a cart corral having a bar, the guard comprising:

a first side wall having an outer surface and an inner surface defining a first boss and a second boss, the outer surface including a projection;

a second side wall having an outer surface and an inner surface defining a first boss and a second boss, the outer surface including a projection, the inner surface of the first side panel juxtaposed with the inner surface of the second side panel to define a gap therebetween; and a lateral wall interconnecting the first side panel and the second side panel such that the first bosses cooperate with the first side wall, the second side wall, and the lateral wall to at least partially define a channel that is sized to removably receive the bar and the second bosses contact one another to maintain the gap between the first and second side panels.

19. The guard of claim 18, wherein each of the first bosses further comprises a plurality of bosses defining an upper row of bosses and wherein each of the second bosses further comprises a plurality of bosses defining a lower row of bosses.

20. The cart corral of claim 1, further comprising a plurality of fasteners that extend through the side panel to attach the side panel to the bar.

21. The guard of claim 11, further comprising a first bolt extending through the upper boss and the outer wall and a second bolt extending through the lower boss and the outer wall, the first and the second bolt cooperating to at least partially attach the outer wall to the upper bar and the lower bar.

22. The guard of claim 18, further comprising a plurality of bolts extending through the first side panel and the second side panel.

* * * * *